US005949457A

United States Patent [19]

Sasaki

[11] Patent Number: 5,949,457

[45] **Date of Patent: *Sep. 7, 1999**

[54] CONNECTING STRUCTURE FOR A HEAD HOLDER AND INK CARTRIDGE

[75] Inventor: Toyonori Sasaki, Anjo, Japan

[73] Assignee: Brother Kogyo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/638,564

[22] Filed: Apr. 26, 1996

[30] Foreign Application Priority Data

Aug. 1, 1995 [JP] Japan ..... 7-216670

[51] Int. Cl.[6] ..... B41J 2/175

[52] U.S. Cl. ..... 347/86

[58] Field of Search ..... 347/86, 87, 49, 347/50

[56] References Cited

U.S. PATENT DOCUMENTS

| | | | |
|---|---|---|---|
| 4,593,294 | 6/1986 | Parisi | 347/86 |
| 5,552,816 | 9/1996 | Oda et al. | 347/86 |
| 5,576,749 | 11/1996 | Mochizuki et al. | 347/86 |
| 5,619,239 | 4/1997 | Kotaki et al. | 347/86 |

FOREIGN PATENT DOCUMENTS

| | | | |
|---|---|---|---|
| 2100977 | 1/1994 | Canada . | |
| 0 408 241 A2 | 1/1991 | European Pat. Off. . | |
| 0 546 544 A2 | 6/1993 | European Pat. Off. . | |
| 0 580 433 | 1/1994 | European Pat. Off. . | |
| 0 639 462 A2 | 2/1995 | European Pat. Off. . | |
| 0 655 336 A1 | 5/1995 | European Pat. Off. . | |
| 0 756 936 A2 | 2/1997 | European Pat. Off. . | |
| 2543991 | 4/1977 | Germany | 347/86 |
| 299360 | 4/1992 | Germany | 347/86 |
| 57243 | 3/1988 | Japan | 347/86 |

*Primary Examiner*—N. Le
*Assistant Examiner*—L. Anderson
*Attorney, Agent, or Firm*—Oliff & Berridge PLC

[57] ABSTRACT

A connecting structure for a head holder and ink cartridge assures proper positioning of the cartridge and avoids damaging ink supply components. The ink cartridge defines a protrusion distance for a grip section of a cartridge, which protrudes outward from the rear surface of the ink container. The protrusion distance is larger than a protrusion distance of an ink supply member of a head holder, which protrudes from the inner surface of the front wall. Also, the height from a surface of a bottom wall in the head holder to the bottom edge of the grip section is larger than a height from a surface of the bottom wall to a top edge of the ink supply member. The inner wall surface of a pair of mutually opposite side walls is formed, integrally continuing from the opening of the ink container in each cartridge. Also, the wall thickness of the upper section is smaller than that of the upper section. The width of the upper section is larger than the width of the lower section. Thus, each cartridge can only is mounted in a cartridge mounting section provided between partition walls, which are formed on the bottom plate of the head holder through the lower section of the ink container.

22 Claims, 10 Drawing Sheets

CONNECTING STRUCTURE FOR A HEAD HOLDER AND INK CARTRIDGE

BACKGROUND OF THE INVENTION

1. Field of the Invention

The present invention relates to a cooperating connecting structure of a head holder and an ink cartridge for connecting the head holder attached on an ink jet printer for mounting an ink jet head to an ink cartridge. The ink cartridge is removably mounted on the head holder and supplies ink to the ink jet head. In particular, the invention relates to a connecting structure of a head holder and an ink cartridge that reliably prevents damage to an ink filter of an ink supply member mounted on the head holder, if the ink cartridge is mounted in a wrong direction or upside down. The ink supply member connects the ink jet head to the ink cartridge and supplies the ink from the ink cartridge to the ink jet head.

2. Description of the Related Art

There have been various kinds of known ink cartridges for use in ink jet printers. In an ink jet printer capable of printing in colors, for example, black, magenta, yellow and cyan, four separate ink cartridges are generally mounted in the head holder.

A conventional ink cartridge used in this type of ink jet printer will be explained below, with reference to FIG. 12. FIG. 12 is a longitudinal sectional view of the ink cartridge 100. In FIG. 12, the ink cartridge 100 is formed in an approximately rectangular parallelpiped configuration. The ink cartridge 100 comprises an ink container 101 in which an ink-impregnated body G is incorporated. A cartridge cover 103 is joined, for example by welding, to the peripheral edge of the upper opening 102 in the ink container 101. Beneath the front surface 101A (left side in FIG. 12) of the ink container 101, an insertion hole 104 is formed. An ink supply member 109 (described later) is inserted into this insertion hole 104 and is attached to a head holder 106 when the ink cartridge 100 is mounted on the head holder 106. At the rear part of the cartridge cover 103 (right side in FIG. 12), a grip section 105 is formed. This grip section 105 permits gripping of the ink cartridge 100 when the ink cartridge 100 is mounted to, and removed from, the head holder 106.

The grip section 105 is disposed above the rear surface 101B (right side surface in FIG. 12) of the ink container 101. The distance of outward protrusion of the grip section from the rear surface 101B is al as shown in FIG. 12.

The ink cartridge 100 of the above-described structure will not pose mounting problems, so long as it is mounted to the head holder 106 in a proper position and relation to the head holder 106.

The ink cartridge 100, however, is generally small in size, and therefore it is conceivable that the ink cartridge 100 can be improperly mounted. For example, the ink cartridge 100 can be mounted from a wrong direction or upside down onto the head holder 106. Such improper mounting will be explained with reference to FIGS. 13 and 14. FIG. 13 is a longitudinal sectional view showing the ink cartridge 100 mounted in a wrong direction on the head holder 106. FIG. 14 is a cross sectional view of the ink cartridge 100 mounted on the head holder 106.

First, the structure of the head holder 106 will be explained. In FIG. 13, the head holder 106 has a front wall 107 and an integrally formed bottom wall 108. In the front wall 107, an ink supply member 109 comprises an ink hole

109A, which corresponds to the insertion hole 104 when the ink cartridge 100 is properly mounted on the bottom wall 108. At the front end of the ink supply member 109 (right end in FIG. 13), a mesh filter 110 is installed. The mesh filter 110 serves to remove impurities, such as dust in the ink, when the ink is supplied from the ink-impregnated body G in the ink cartridge 100 to the ink jet head 111.

The inward protrusion distance of the ink supply member 109 from the inner surface 107A of the front wall 107 is a2. The protrusion distance a2 is greater than the protrusion distance a1 of the grip section 105, which is formed on the ink cartridge 100. The ink jet head 111 is mounted to the head holder 106 on the front side of the front wall 107, and a head cover 111A is disposed around it.

The head holder 106, as shown in FIG. 14, has a pair of side walls 112, and a plurality of partition walls, or example three partition walls as shown in FIG. 14, formed on the bottom wall 108 between the side walls 112. An ink cartridge 100 is mounted between each pair of partition walls 113.

The peripheral edge of the ink cartridge 100, an opening 101 of the ink container 100 and the cartridge cover 103 are generally joined to each other, for example, by ultrasonic welding. In particular, the surfaces of the ink container 101 and the cartridge cover 104 are welded by shear welding for a substantial amount of weld strength. Also, an outside portion of protrusion 114, which is formed on the underside of the cartridge cover 103, and an inside step section of the peripheral edge of the opening, which is formed in the ink container 101, are joined, for example by welding, as shown in FIG. 14. Therefore, with shear welding, the peripheral edge of the opening of the ink container 101 should be at least 1.5 mm thick. To meet this requirement, a pair of opposite side walls 115 in the ink container 101 of a conventional ink cartridge 100, are 1.5 mm thick throughout. The whole body of the ink cartridge 100, has the substantially same vertical width.

If the above ink cartridge 100 is mounted in an incorrect direction between the side wall 112 and the partition wall 113 in the bottom wall 108 of the head holder 106, the rear surface 101B of the ink container 101 faces the mesh filter 110 of the ink supply member 109, as shown in FIG. 13. At this time, the protrusion distance a2 of the ink supply member 109 extending inward from the inner surface 107A of the side wall 107 is greater than the protrusion distance a1 of the grip section 105 formed on the ink cartridge 100. Therefore, the mesh filter 110 of the ink supply member 109 contacts the rear surface 101B of the ink container 101, consequently damaging the mesh filter 110.

The ink cartridge 100, which is formed with the same width in the vertical direction, can be mounted between the side wall 112 and the partition wall 113, even if mounted upside down in the head holder 106. However, if the ink cartridge 100 is mounted upside down, the mesh filter 110 of the ink supply member 109 contacts the rear surface 101B of the ink container 101, and for the same reasons stated above, results in a damaged mesh filter 110. Furthermore, if the ink cartridge 100 is mounted upside down on the head holder 106, the mesh filter 110 of the ink supply member 109 will immediately contact the front surface 101A of the ink container 101, because the grip section 105 is not present on the front surface 101A. In this case, the mesh filter 110 is also likely to be damaged.

Therefore, if a conventional ink cartridge 100 is mounted in a wrong direction or upside down on the head holder 106, the mesh filter 110 mounted on the forward end of the ink supply member 109 will be damaged.

SUMMARY OF THE INVENTION

To overcome the above-described problems of the conventional connecting structure of a head holder and an ink cartridge, the invention provides as one of its objects a connecting structure, which can reliably prevent damage to the filter of the ink supply member that supplies the ink to the ink jet head from an ink cartridge mounted on the head holder and connected with the ink jet head.

To accomplish the above and other objects, the connecting structure comprises a head holder having front and bottom walls, an ink supply member protruding inwardly from the inner surface of the front wall to supply ink to an ink jet head, a filter mounted at the front end of the ink supply member, a cartridge mounting section formed in the bottom wall, and an ink cartridge having an approximately rectangular parallelpiped configuration with an insertion hole formed in a front surface facing an inner surface of the front wall of the head holder. This allows insertion of the ink supply member and its mounting in the cartridge mounting section. The ink cartridge is provided with a protrusive section protruding outwardly from a rear surface of the ink cartridge at a height different from the front end of the ink supply member. A first protrusion distance of the protrusive section is greater than a second protrusion distance of the ink supply member, measured from the inner surface of the front wall of the head holder.

According to the above connecting structure, the ink cartridge is provided with a protrusive section, which protrudes outward from the rear surface of the ink cartridge at a height different from the front end of the ink supply member. The first protrusion distance of the protrusive section, which protrudes rearward from the rear surface of the ink cartridge, is greater than the second protrusion distance of the ink supply member, which protrudes from the inner surface of the front wall of the head holder. Therefore, if the ink cartridge is mounted in the cartridge mounting section of the bottom wall in a wrong direction, the ink supply member can be mounted in a space defined by the rear surface of the rear part of the ink cartridge and the protrusive section, without its front end contacting the rear surface of the ink cartridge. Accordingly, if the ink cartridge is mounted in the wrong direction, it is possible to prevent damage to the ink supply member.

Furthermore, the protrusion section comprises a grip section protruding outwardly from the upper rear surface of the ink cartridge. A first height from an upper surface of the bottom wall of the head holder to a bottom edge of the grip section is greater than a second height from the upper surface of the bottom wall to a top edge of the ink supply member. The grip section of the cartridge is, therefore, usable as the protrusive section. Consequently, it is unnecessary to provide a new protrusive section, separate from the grip section, for handling the cartridge. This facilitates manufacture and handling of the ink cartridge.

Furthermore, another object of the invention is achieved by providing the head holder with at least one partition wall, which positions the ink cartridge by contacting the upper or lower outer surface of the ink cartridge. Since the ink portion of the cartridge that contacts the partition wall has a smaller width than other portions of the ink cartridge, if it is mounted upside down, it can not be mounted between the partition walls. Therefore, mounting of the ink cartridge upside down is prevented.

The invention achieves other objects by providing a connecting structure of a head holder and an ink cartridge, which is able to prevent damage to the filter of the ink supply member that supplies the ink to the ink jet head from the ink cartridge mounted in the head holder with the ink jet head connected to the ink cartridge, even when the ink cartridge is mounted in a wrong direction. Further, damage is prevented when the ink cartridge is mounted upside down in the head holder.

DESCRIPTION OF THE PREFERRED EMBODIMENTS

Hereinafter the preferred embodiments of the connecting structure of a head holder and an ink cartridge according to the invention will be explained with reference to the drawings. First, the general structure of an ink jet printer to which the connecting structure of the invention is incorporated will be explained, with reference to FIG. 1.

Figure 1:
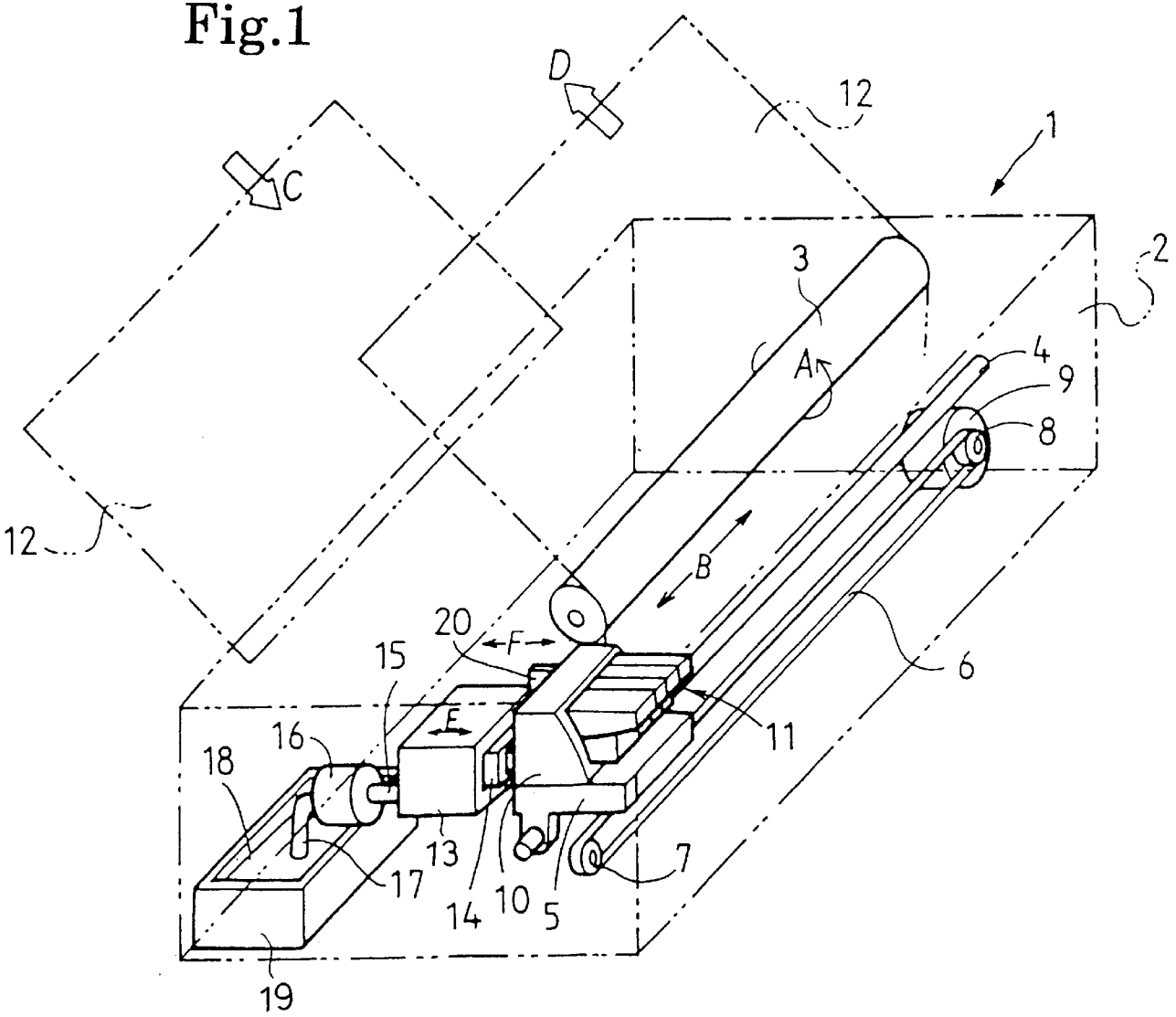
FIG. 1 is a perspective view of an ink jet printer.

FIG. 1 is a schematic perspective view of an ink jet printer. In FIG. 1, a platen 3 is mounted so as to rotate in the direction of arrow A in the housing 2 of a printer 1. A guide shaft 4 is mounted generally parallel to the platen 3. A carriage 5 is slidably mounted on the guide shaft 4. A belt 6 is installed on the carriage 5. The belt 6 is wrapped around an idle pulley 7 and a drive pulley 8. The drive pulley 8 is rotated by a drive, such as a driving motor 9. With the rotation of the drive pulley 8, the carriage 5 traverses along the guide shaft 4 via the belt 6 in the direction of the arrow B in FIG. 1.

Figure 5:
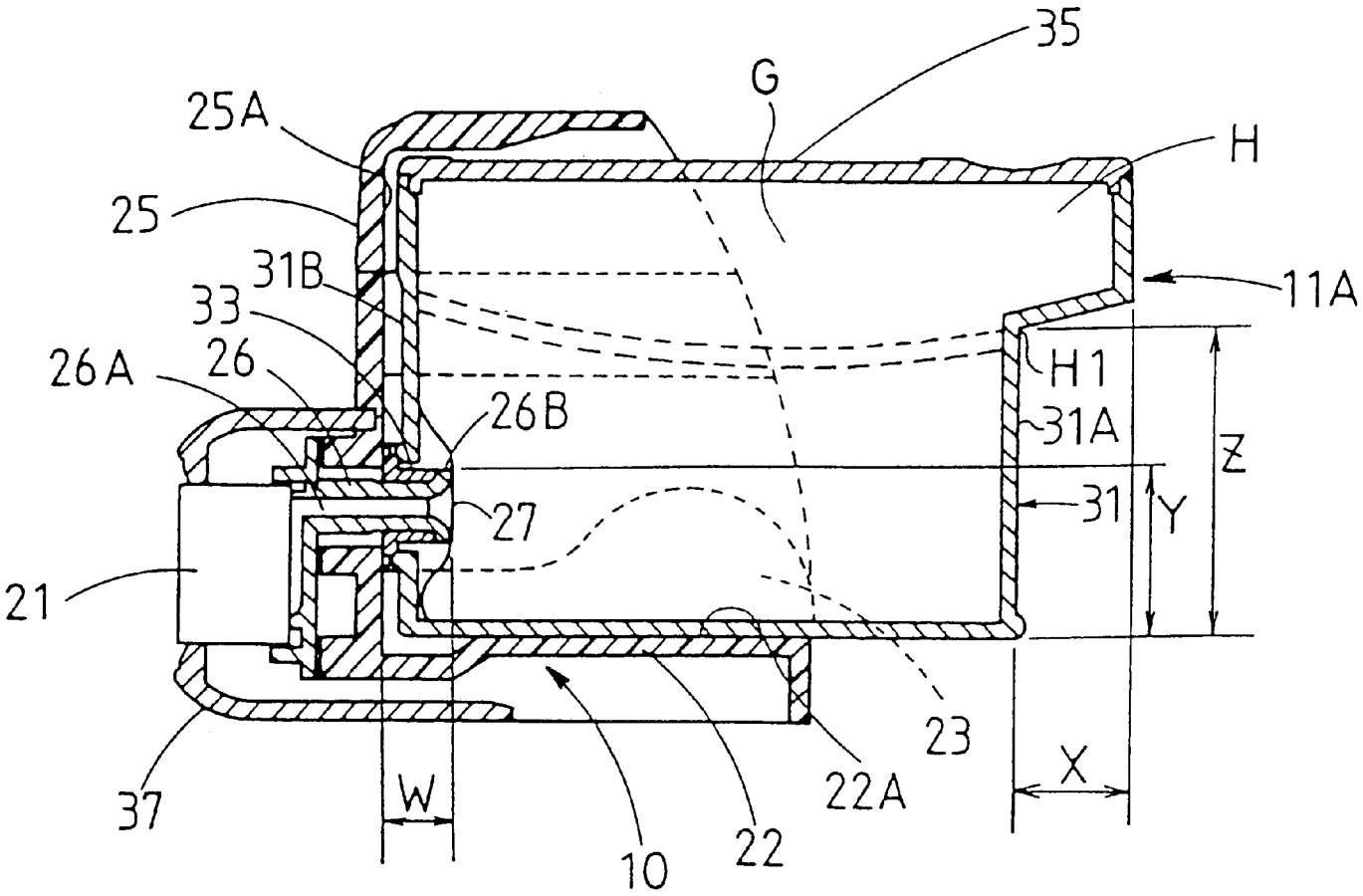
FIG. 5 is a longitudinal sectional view of the head holder illustrating each cartridge mounted on the head holder.

A head holder 10 is mounted opposite the platen 3 on the carriage 5. Further, an ink cartridge 11 is mounted on the head holder 10. An ink jet head 21 is installed on a front surface of the head holder 10, as shown in FIG. 5.

A plurality of ink passages are formed in the ink jet head 21. A nozzle (not illustrated) is provided, corresponding to each ink passage. As described hereinafter, the ink is supplied from the ink cartridge 11 to the ink jet head 21.

A printing paper 12 is inserted at the rear part of the printer in the direction of arrow C in FIG. 1. The paper 12 is fed in along the platen 3, and is discharged out of the housing 2 in the direction of arrow D. As the printing paper 12 is fed to the platen 3, ink is emitted from the jet head 21 as the carriage 5 moves. Thus, data can be printed on the paper 12.

A cap 13 is provided in a nonprinting position of the ink jet head 21 on the left side of the platen 3 in FIG. 1. The cap 13 is fit with a rubber cap 14 closely mounted to the head 21. The cap 13 is movably mounted to the head 21 in the direction of arrow E in FIG. 1. The cap 13 is moved by a moving device or means (not illustrated), thus closely mounting the rubber cap 14 to the head 21.

The cap 13 is connected to a connecting tube 15, which is connected with a pump 16. The pump 16 is connected with a discharge tube 17. The discharge tube 17 is connected with a used ink tank 19 in which an absorbent 18 is inserted.

A flexible wiper blade 20 is provided between the platen 3 in the nonprinting position and the cap 13. The wiper blade 20 is movably installed and moves in the direction of arrow F in FIG. 1. The wiper blade 20 is normally maintained in the retreat position, where it is out of contact with the head 21. During wiping, the wiper blade 20 is moved by a motor (not illustrated) to an advanced position, where it is in sliding contact with the head 21.

Figure 2:
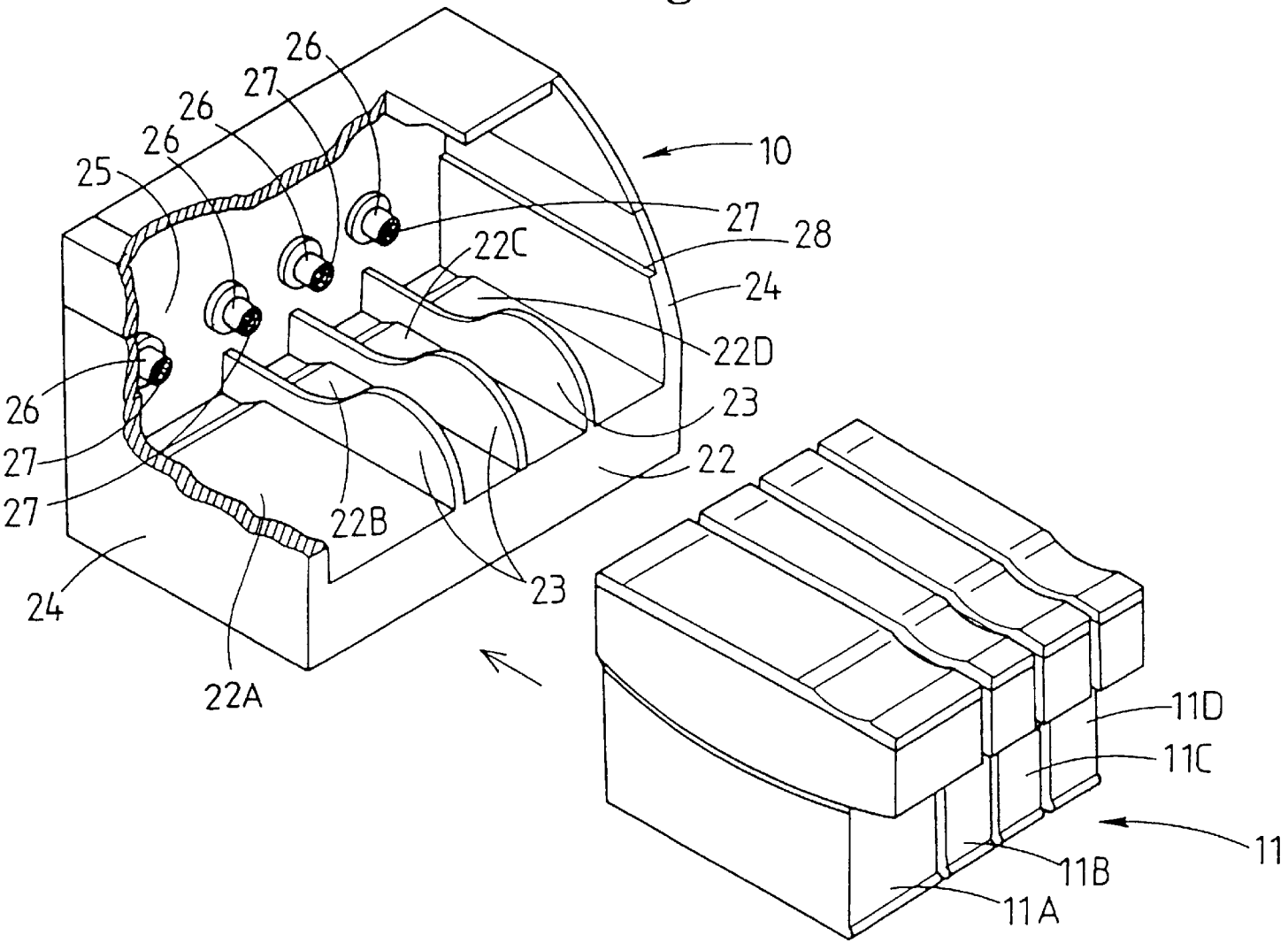
FIG. 2 is a schematic perspective view of an ink cartridge mounted on a head holder according to a first preferred embodiment of the invention.

Next, the connecting structure for connecting the head holder 10 to the ink cartridge 11 will be explained with reference to FIG. 2. FIG. 2 is a schematic perspective view of the ink cartridge 11 mounted on the head holder 10.

In FIG. 2, three partition walls 23 are provided on a bottom wall 22 of the head holder 10. Between a pair of side walls 24, the bottom wall 22 is divided by the partition walls 23 into four cartridge mounting sections 22A, 22B, 22C and 22D.

The cartridge mounting section 22A is larger than the three other cartridge mounting sections 22B–22D. A cartridge 11A charged with black ink is mounted in this cartridge mounting section 22A. Each of the cartridge mounting sections 22B, 22C, and 22D has substantially the same size and is fit with cartridges 11B, 11C and 11D charged with ink, for example, cyanic, magenta and yellows, respectively. The black ink cartridge 11A has a larger volume than the other color ink cartridges 11B, 11C and 11D, because black is more frequently used than the other colors.

Furthermore, on the inner surface side of a front wall 25 of the head holder 10, four ink supply members 26 are formed, corresponding to each of the cartridges 11A–11D. Each ink supply member 26 functions to supply the ink from each cartridge 11A–11D to the ink jet head 21 (see FIG. 5) disposed on the outer surface of the front wall 25. A mesh filter 27 is mounted on the front end of ink supply member 26. Each mesh filter 27 functions removes foreign materials from the ink supplied from each of the cartridges 11A–11D, and to supply clean ink to the ink jet head 21. A stepped section 28 is formed adjacent to a stepped section 32 (described hereinafter) of the cartridges 11A–11D on the inner surface side of each side wall 24 (only the inner surface of one side wall 24 is shown in FIG. 2).

Figure 3:
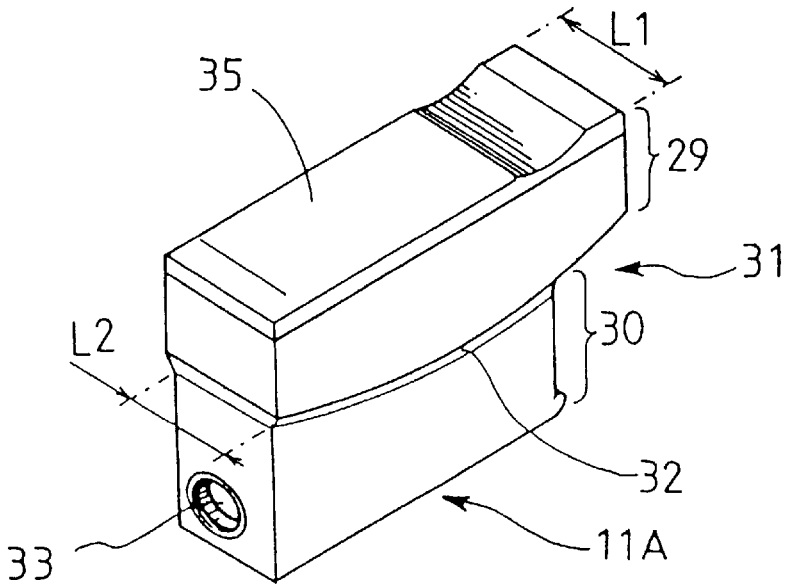
FIG. 3 is a perspective view illustrating one cartridge from the front side.
Figure 4:
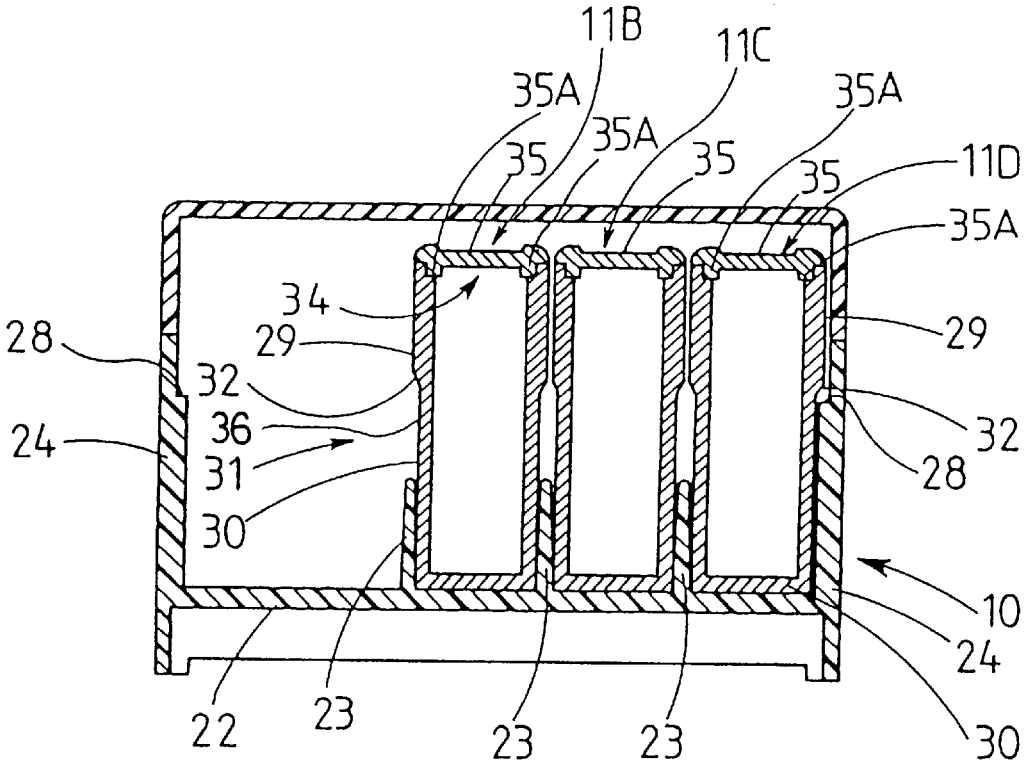
FIG. 4 is a cross sectional view of each cartridge mounted on the head holder.

Next, the structure of each of the cartridges 11A–11D will be explained, with reference to FIGS. 3 and 4. FIG. 3 is a perspective view showing cartridge 11A from the front side, and FIG. 4 is a cross section of each of the cartridges 11B–11D mounted on the head holder 10. The cartridge 11A has basically the same construction as the other three cartridges 11B–11D, except for a different size. Therefore, only the cartridge 11A will be explained as an example.

In FIG. 3, the cartridge 11A has an ink container 31 comprising two sections: an upper section 29 and a lower section 30. The width L1 of the upper section 29 is greater than the width L2 of the lower section 30. Accordingly, a stepped section 32 is formed at a boundary between the upper section 29 and lower section 30. The width L1 of the upper section 29 being greater than the width L2 of the lower section 30 will be described hereinafter with reference to specific structure.

An insertion hole 33 for the ink supply member 26 is provided on the front side (left surface side in FIG. 3) of the ink container 31 of the cartridge 11A. The insertion hole 33 serves as an ink supply hole, through which the is supplied to the ink-impregnated body G (FIG. 5) in each of the cartridges 11A–11D, to the ink is supplied through the mesh filter 27 and the ink supply member 26 to the ink jet head 21.

Furthermore, a cartridge cover or cover body 35 is joined, for example by welding or shear welding, to the opening 34 (FIG. 4) of the upper section 29. On the rear surface side of the ink container 31 (right surface side in FIG. 3), a grip or protruding section H is formed protruding outwardly from an upper part. The grip section H facilitates holding the ink cartridge 11A during replacement.

In each of the cartridges 11B–11D, shown in FIG. 4, a pair of mutually opposite side walls 36 contact each partition wall 23. The side walls 36 are integrally formed with the upper section 29 and the lower section 30. The side walls 36 extend to the opening 34 and have a planar inner wall surface. Accordingly, the inner wall surfaces of the upper section 29 and the lower section 30 are substantially co-planar.

The upper section 29 of the side wall 36 is formed of a suitable thickness, for example 1.5 mm thick. The inner side of the stepped section of the opening 34 of the ink container 31 and the protruding section 35A on the underside of the cartridge cover 35 will be formed, for example by shear welding. On the other hand, the lower section 30 of the side wall 36 has a large wall thickness preventing deformation if the cartridge 11B is mounted between the partition walls 23. Therefore, it is possible to decrease the wall thickness of the lower section 30 to be less than the upper section 29, for example 1.0 mm. Therefore, a difference of 0.5 mm between the wall thickness of the upper section 29 and that of the lower section 30 in the side wall 36 exists. Moreover, a difference of 1.0 mm between the width L1 of the upper section 29 and the width L2 of the lower section 30 in the two side walls 36 also exists.

In each cartridge 11A–11D, the width L1 of the upper section 29 is larger than the width L2 of the lower section 30. Furthermore, the inner wall surface of the pair of mutually opposite side walls 36, which integrally continue to the opening 34 of the ink container 31, is substantially planar. The wall thickness, for example 1.0 mm, of the lower section 30 of the side wall 36 is less than the wall thickness, for example 1.5 mm of the upper section 29.

In conventional devices, the upper and lower sections have an equal width, and the side wall of the ink container has a constant thickness from the upper part to the lower part. On the other hand, each of the cartridges 11A–11D of the invention is mounted to the cartridge mounting sections 22A–22D between the partition walls 23, via the lower section 30 of the ink container 31. Therefore, the cartridges have an increased volume with respect to conventional cartridges, and it is possible to increase the ink amount in the ink container 31. In other words, it is possible to decrease the relative size of each of the cartridges 11A–11D, and accordingly decrease the size of the head holder 10 and the carriage 5, when compared with a conventional ink cartridge.

Next, the structure for connecting each of the cartridges 11A–11D to the ink jet head 21 in the head holder 10 will be explained, with reference to FIG. 5. FIG. 5 is a longitudinal section view of the head holder 10 showing each of the cartridges 11A–11D mounted on the head holder 10. Each of the cartridges 11A–11D have the same general structure, and will be explained with reference to FIG. 5.

In FIG. 5, cartridge 11A is mounted between the partition walls 23 of the cartridge mounting section 22A on the bottom wall 22 in the head holder 10. The cartridge 11A has a semicircular lug protruding from the rear lower end thereof, so that an elastic locking member of the carriage engages it and prevents the rear end of the cartridge from raising up. When each of the cartridges 11A–11D is in its mounted position, the forward end (left end in FIG. 5) of the ink supply member 26 is attached to the front surface of the head holder 10, and is inserted into each of the cartridges 11A–11D through the insertion hole 33. Thereby, the mesh filter 27, attached to the ink supply member 26, is pressed against the ink-impregnated body G in each of the cartridges 11A–11D. As a result, ink impregnated in the ink-impregnated body G is fed to the ink jet head 21 through an ink hole 26A of the ink supply member 26, after removal of foreign matters by the mesh filter 27. The ink jet head 21 is attached on the front wall 25 of the head holder 10, and a head cover 37 is disposed around it.

Also, in each of the cartridges 11A–11D, the protrusion distance or first protrusion distance of the grip section H from the rear surface 31A of the ink container 31 is X. In the head holder 10, the protrusion distance or second protrusion distance of the ink supply member 26 from the inner surface 25A of the front wall 25 is W. The protrusion distance X of the grip section H is greater than the protrusion distance W of the ink supply member 26.

A first height from the upper surface 22A of the bottom wall 22 to the bottom edge H1 of the grip section H is Z. A second height from the upper surface 22A, which contacts the lower surface of the ink container 31, of the bottom wall 22 in the head holder 10 to the top edge 26B of the ink supply member 26 is Y. The grip section H is formed to extend rearwardly from each of the cartridges 11A–11D at a different height than the forward end of the ink supply member 26. For example, the height can be at a level higher than the forward end of the ink supply member 26, whereby the height Z to the bottom edge H1 of the grip section H is greater than the height Y to the top edge 26B of the ink supply member 26.

When the ink in each of the cartridges 11A–11D is exhausted, each of the cartridges 11A–11D will be replaced. A cartridge 11A can be held by the grip section H, and mounted to the cartridge mounting section 22A. The width L1 of the upper section 29 in each of the cartridges 11A–11D is greater than the width L2 of the lower section 30. The mounting width of the cartridge mounting section 22A for mounting each of the cartridges 11A–11D is approximately the same as the width L2 of the lower section 29. Therefore, the mounting direction of each of the cartridges 11A–11D with respect to each of the cartridge mounting sections 22A–22D is predetermined preventing mis-mounting.

However, an operator may inadvertently attempt to mount a cartridge in a wrong direction or upside down in each of the cartridge mounting sections 22A–22D during cartridge replacement. Since each of the cartridges 11A–11D is provided with the insertion hole 33 only near the lower part of the front surface 31B, the front upper wall section or rear wall section of the cartridges 11A–11D could contact the mesh filter 27 mounted to the ink supply member 26, damaging the mesh filter 27. It is therefore necessary to prevent this contact to avoid damage.

The protrusion distance X of the grip section H is larger than the protrusion distance W of the ink supply member 26. Also, the height Z to the bottom edge H1 of the grip section H is larger than the height Y to the top edge 26B of the ink supply member 26. Additionally, in each of the cartridges 11A–11D, the width L1 of the upper section 29 is larger than the width L2 of the lower section 30. Therefore, if any of the cartridges 11A–11D is mounted in a incorrect direction or orientation to each of the cartridge mounting sections 22A–22D, the wall surface of the ink container 31 will be prevented from abutting the mesh filter 27 of the ink supply member 26. Also, the mounting each of the cartridges 11A–11D upside down in each of the cartridge mounting sections 22A–22D is prevented.

Figure 6:
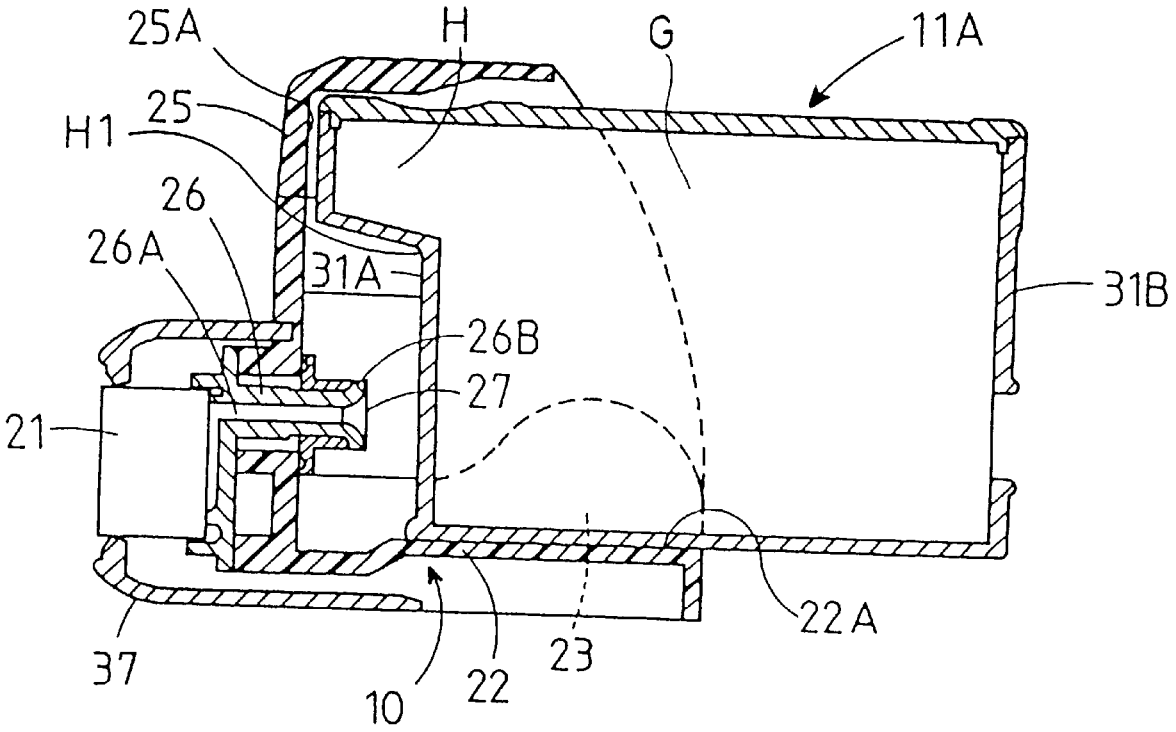
FIG. 6 is a schematic view of a cartridge mounted in a wrong direction in the cartridge mounting section.
Figure 7:
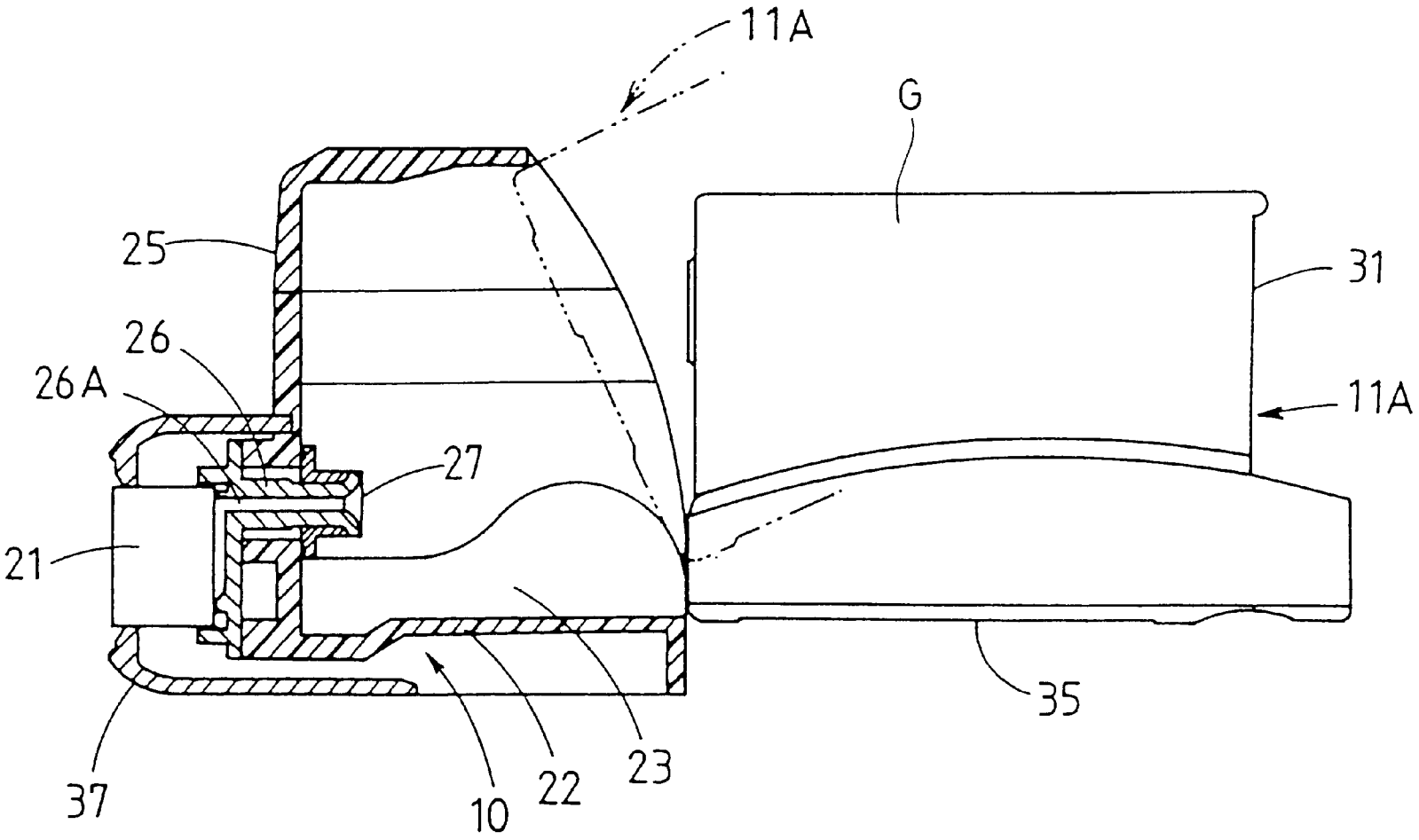
FIG. 7 is a schematic view of a cartridge being mounted upside down from the front side in the cartridge mounting section.
Figure 8:
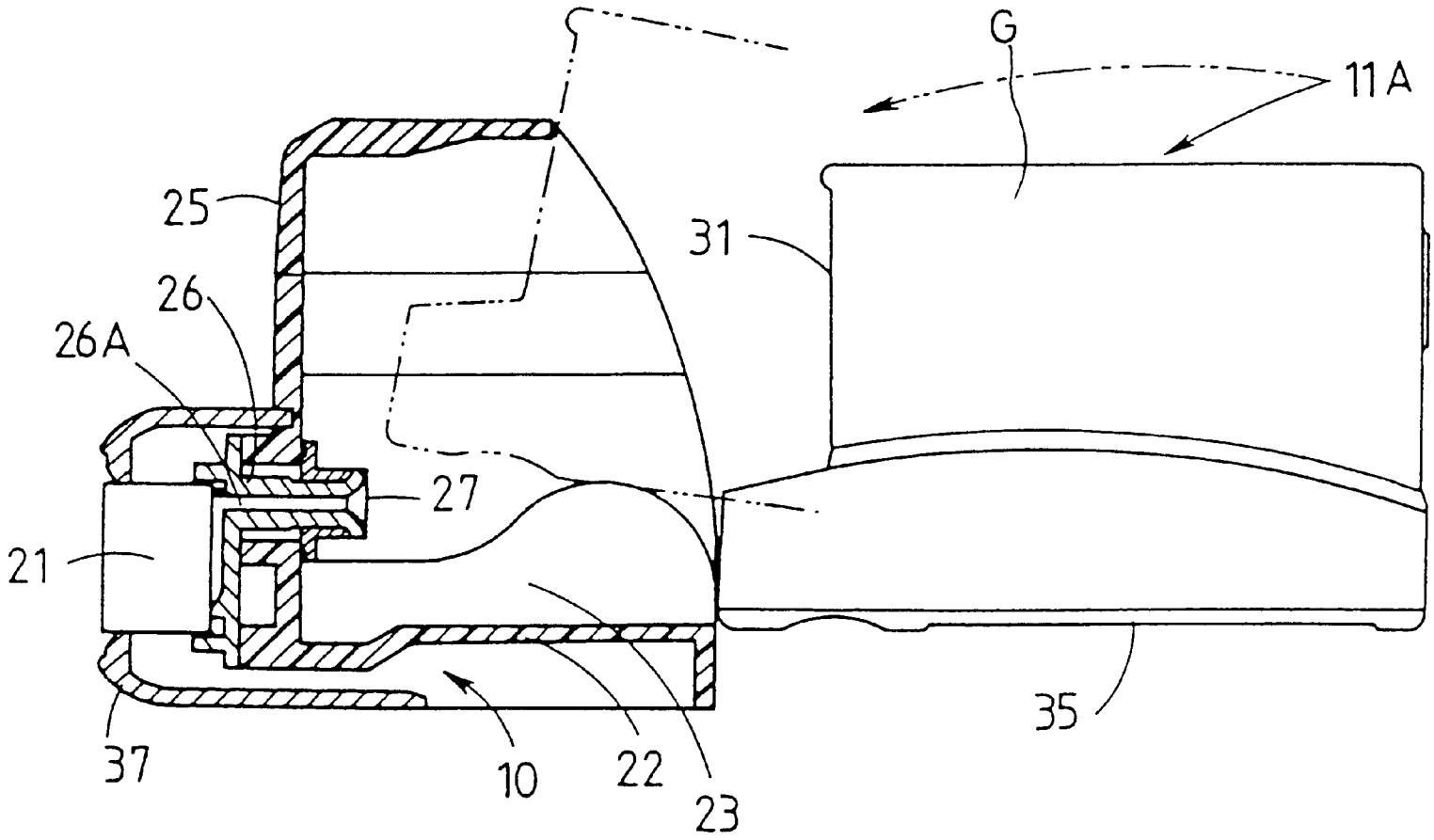
FIG. 8 is a schematic view of a cartridge being mounted upside down from the rear side in the cartridge mounting section.

Here, improperly mounted cartridge, for example cartridge 11A, will be explained with reference to FIGS. 6–8. As the cartridges 11A–11D have substantially the same structure, cartridge 11A is shown as an example in FIGS. 6–8. FIG. 6 is a schematic explanatory view illustrating a cartridge mounted in a wrong direction in a mounting sections 22A–22D; FIG. 7 is a schematic explanatory view of a cartridge 11A, being mounted upside down from the front side to the cartridge mounting sections; and FIG. 8 is a schematic explanatory view of a cartridge 11A being mounted upside down from the rear side to the cartridge mounting sections 22A–22D.

As shown in FIG. 5, when the cartridge 11A is properly mounted to the cartridge mounting section 22A, the ink supply member 26 attached on the head holder 10, is inserted in the insertion hole 33 of the cartridge 11A and presses the ink-impregnated body G to force the ink out. Thus, the ink is supplied to the ink jet head 21 through the ink hole 26A. Meanwhile, if the cartridge 11A is mounted in a wrong direction with respect to the cartridge mounting section 22A, the ink supply member 26 will be positioned in a space defined by the grip section H and the rear surface 31A of the ink container 31, shown in FIG. 6. Accordingly, the mesh filter 27 does not abut the wall surface, for example the rear surface 31A of the ink container 31.

The protrusion distance X of the grip section H is greater than the protrusion distance W of the ink supply member 26, and the height Z to the bottom edge H1 of the grip section H is greater than the height Y to the top edge 26B of the ink supply member 26. Thereby, this structure reliably prevents the mesh filter 27 from abutting the side surface of the ink container 31. Accordingly, damage to the mesh filter 27 is prevented.

Furthermore, if the cartridge 13A is mounted upside down from the front side to the cartridge mounting section 22A, as shown in FIG. 7, the cartridge 11A can not be fit in and mounted in the mounting section 22A. This is because the width L1 of the upper section 29 of the cartridge 11A is greater than the width of the cartridge mounting section 22A. Therefore, prevention of improper mounting of the cartridge 11A to the mounting section 22A is achieved. This protects the mesh filter 27 from damage.

As described above, if each of the cartridges 11A–11D is mounted in a wrong or improper orientation or direction to the cartridge mounting section 22A–22D, the ink supply member 26 will be within a space defined by the grip section H and the rear surface 31A of the ink container 31. Moreover, if each of the cartridges 11A–11D is mounted upside down from the front side to the cartridge mounting section 22A–22D, or similarly from the rear side to the cartridge mounting section 22A–22D, the cartridge 11A–11D can not be mounted in each of the cartridge mounting sections 22A–22D. Therefore, damage to the mesh filter 27 is prevented.

As explained, the protrusion distance X of the grip section H protruding outward from the rear surface 31A of the ink container 31 is greater than the protrusion distance W of the ink supply member 26 in the head holder 10 from the inner surface 25A of the front wall 25. Also, the height Z from the bottom edge H1 of the grip section H to the upper surface 22A of the bottom wall 22 in the head holder 10 is greater than the height Y from the upper surface 22A of the bottom wall 22 to the top edge 26B of the ink supply member 26. Therefore, if each of the cartridges 11A–11D is mounted in a wrong direction to each of the cartridge mounting sections 22A–22D, a space defined by the grip section H and the rear surface 31A of the ink container 31 will prevent the mesh filter 27 from abutting and contacting the wall surface of the ink container 31. Thereby, damage to the mesh filter 27 is prevented.

Also, the width L1 of the upper section 29 of the ink cartridge 11A is larger than the width L2 of the lower section 30. Furthermore, the inner wall surfaces of the pair of mutually opposite side walls 36 are substantially flat, and integrally continuing to the opening 34 of the ink container 31 in the cartridge 11A. In each cartridge side wall 36, the wall thickness of the lower section 30 is smaller than that of the upper section 29. Thus, each cartridge 11A can only be mounted in the cartridge mounting section 22A between the partition walls 23 formed on the bottom plate 22 of the head holder 10 through the lower section 30 of the ink container 31 in the proper orientation. Moreover, the amount of ink to be charged in the cartridge can be increased.

Furthermore, if each of the cartridges 11A–11D is mounted upside down from the front side in the cartridge mounting section 22A–22D, or similarly from the rear side in the cartridge mounting section 22A–22D, it is impossible to mount each of the cartridges 11A–11D. Accordingly, each of the cartridges 11A–11D can be prevented from being mounted upside down, and thereby reliably prevent damaging the mesh filter 27.

Furthermore, as compared with a conventional ink cartridge in which the upper and lower sections are formed with the same width and each side wall of the ink container has a constant thickness from the upper and the lower sections, the instant ink cartridge 11 of the connecting structure allows for an increased amount of ink in the ink container. In other words, each of the cartridges 11A–11D can have a smaller relative size than conventional ink cartridges, without changing the amount of ink in each of the cartridges. Consequently, the head holder 10 and the carriage 5 can be made smaller.

The invention is not limited to the embodiment explained herein. Various improvements and modifications are possible within the scope and spirit of the invention.

Figure 9:
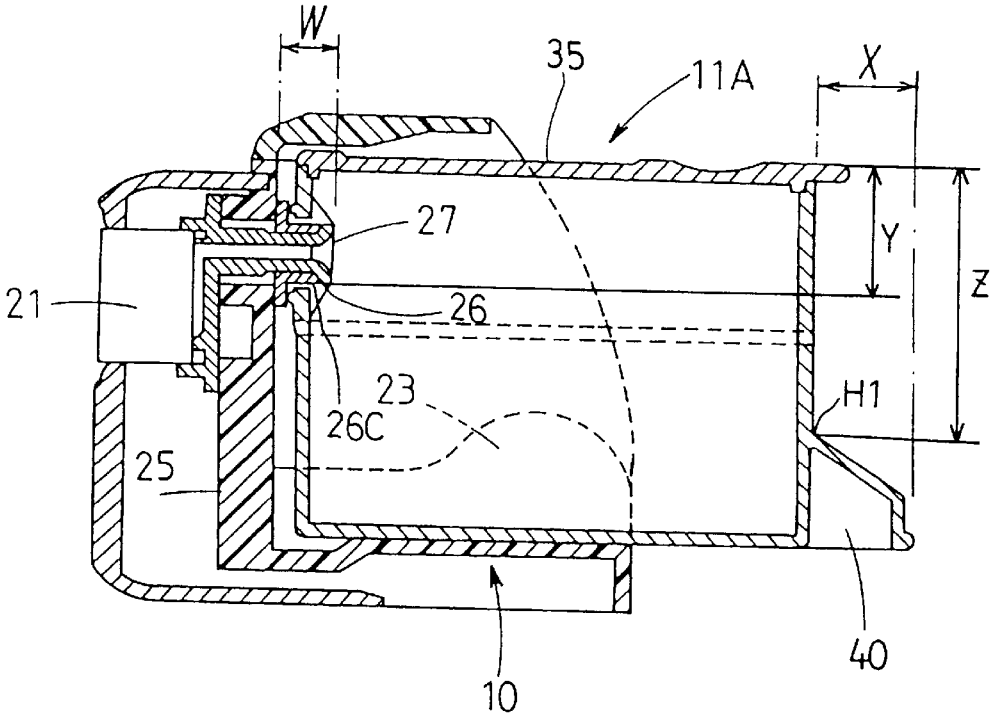
FIG. 9 is a schematic view of a cartridge mounted on the head holder according to a second preferred embodiment of the invention.

For example, the grip section H protruding at the upper rear part of the cartridge 11A–11D is formed as to function as a protrusion. However, a protrusion 40 may be provided protruding rearwardly from a lower rear surface of the cartridge 11A–11D at different levels from the forward end of the ink supply member 26. As shown in a second preferred embodiment of FIG. 9, the ink supply member 26 is mounted in an upper part of the front wall 25 of the head holder 10. In this second preferred embodiment, the height Z from the cartridge cover 35 to the top edge H1 of the grip section is larger than the height Y from the cartridge cover 35 to the bottom edge 26C. Thus, the cartridge 11A–11D when mounted in a wrong direction in the head holder 10 will not have its rear surface contact the forward end of the ink supply member 26. This reliably prevents damage to the mesh filter 27.

Figure 10:
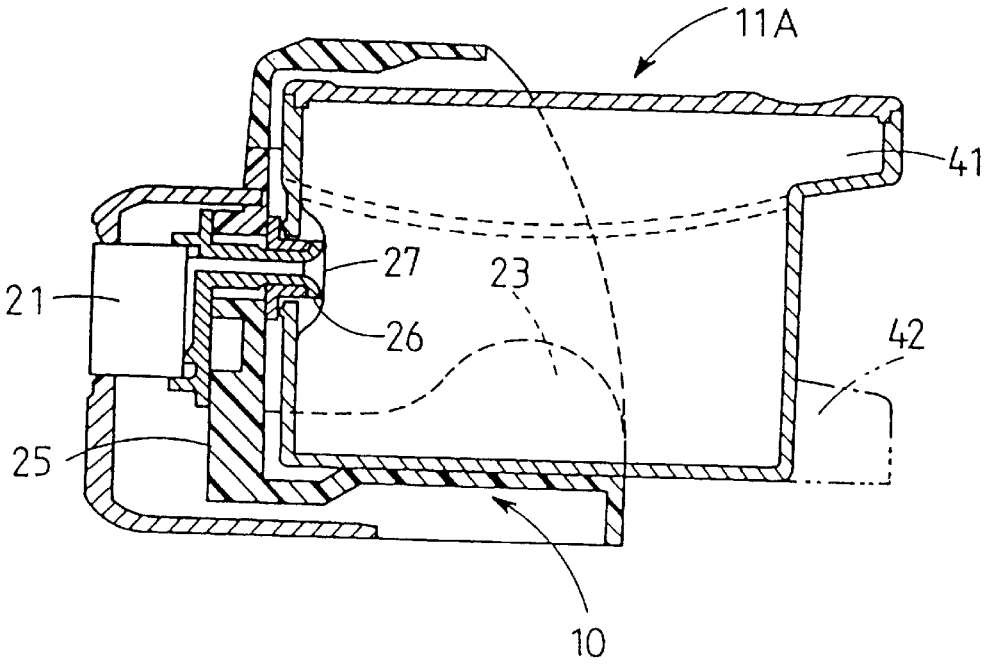
FIG. 10 is a schematic view of a cartridge mounted on the head holder according to a third preferred embodiment of the invention.
Figure 11:
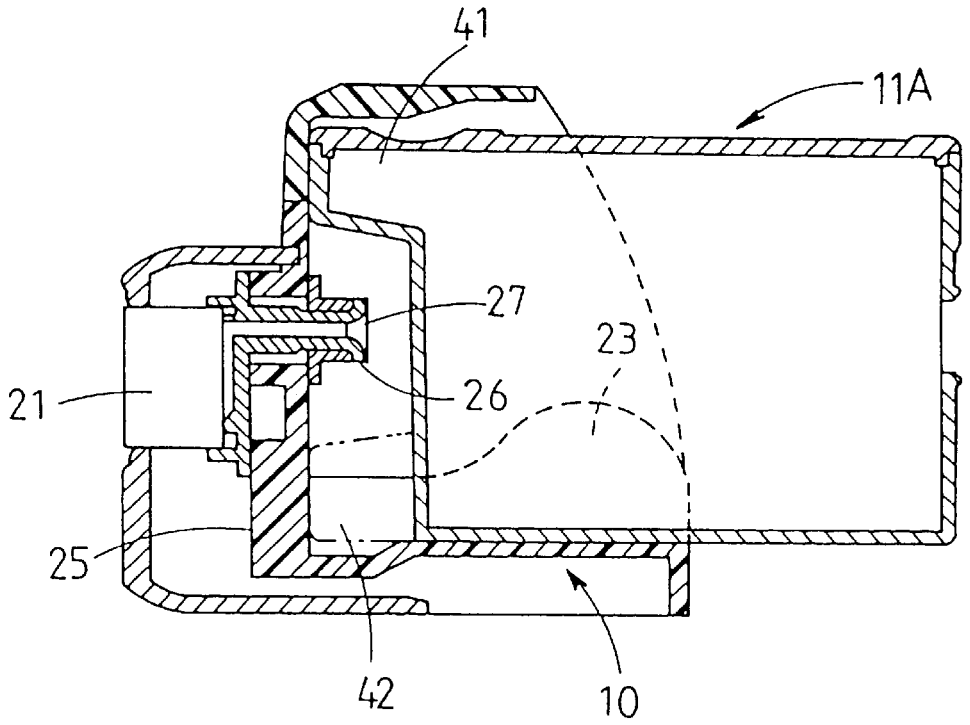
FIG. 11 is a schematic view of a cartridge mounted in a wrong direction in the cartridge mounting section.
Figure 12:
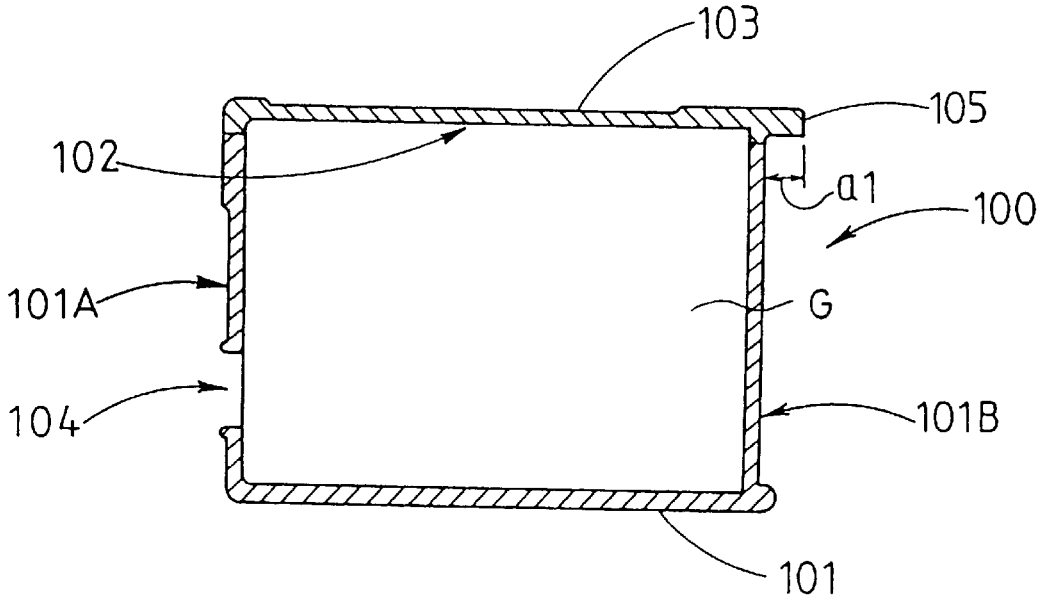
Fig.12 PRIOR ART
FIG. 12 is a longitudinal sectional view of a prior art ink cartridge.
Figure 13:
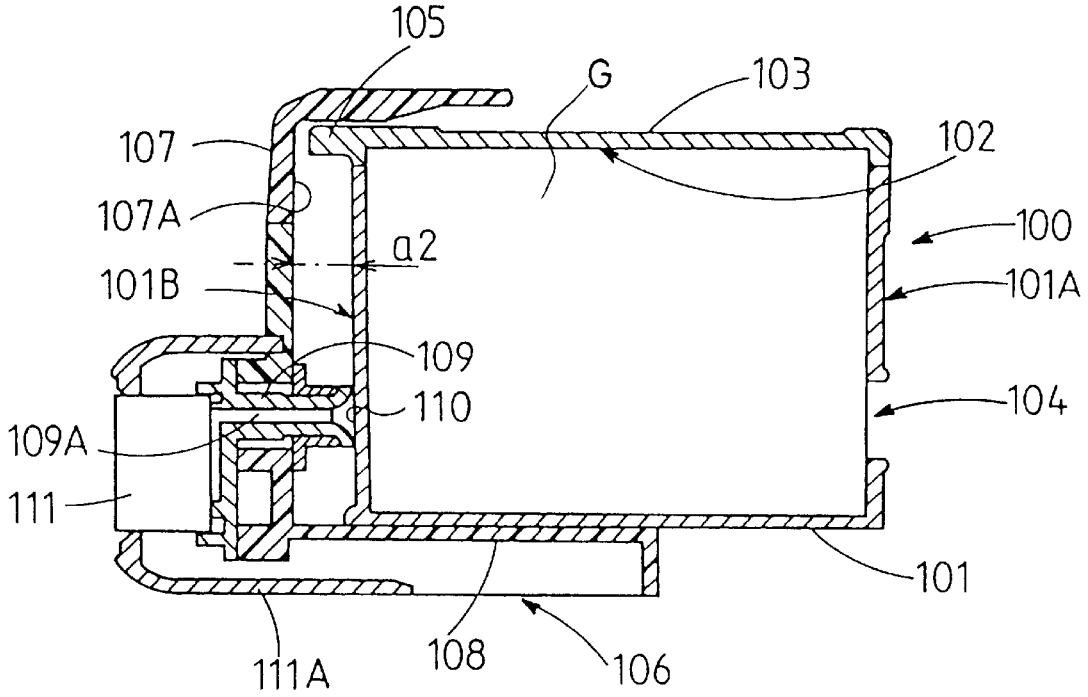
Fig.13 PRIOR ART
FIG. 13 is a longitudinal sectional view of the prior art ink cartridge mounted in a wrong direction on the head holder.
Figure 14:
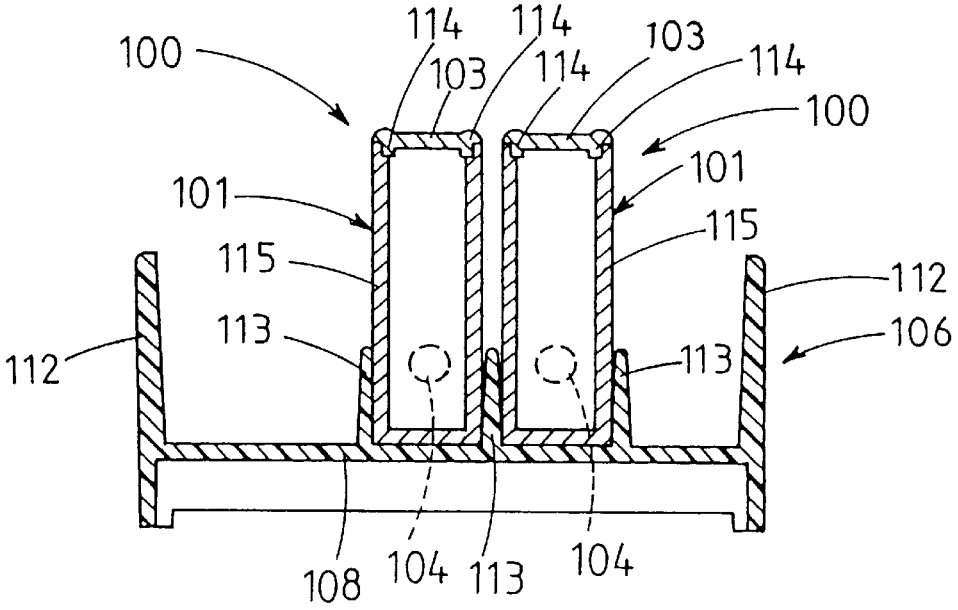
Fig.14 PRIOR ART
FIG. 14 is a cross sectional view of the ink cartridge mounted on a conventional head holder.

A third preferred embodiment is illustrated in FIGS. 10 and 11. Similar characters are represented by similar reference numbers for the other preferred embodiments. The ink supply member 26 is attached at a vertical mid-point in the direction of the head holder 10. A protrusive section 41 is provided and protrudes rearwardly at a level different from the forward end of the ink supply member 26. The protrusive section 41 protrudes from the rear uppermost section of the cartridge 11A–11D. Also, a further protrusive section 42 protrudes rearwardly from the rear lowermost section of the cartridge 11A–11D. Both protrusive sections 41 and 42 may be provided in a single structure.

As is clear from FIG. 11, the rear surface of the cartridge 11A–11D when mounted in a wrong direction in the head holder 10, will not contact the forward end of the ink supply member 26. This reliably prevents damage to the mesh filter 27. When both protrusion sections 41 and 42 are both provided, the pair of side walls 36 of the ink container 31 may extended further rearwardly between these protrusion sections 41 and 42. Thus, a space is formed opening to the rear. The forward end of the ink supply member 26 will be loosely fit within the space due to the contact of one or both of the protrusive sections 41, 42 with the front wall 25.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A connecting structure, comprising:

a head holder and an ink cartridge;

the head holder comprising:

a first wall having a contact portion;

a second wall;

an ink supply member protruding inwardly from an inner surface of said first wall with an ink supply member protrusion distance, the ink supply member supplying ink to an ink jet head;

a filter mounted at an end of said ink supply member; and a cartridge mounting section formed in said second wall;

the ink cartridge comprising:

a first portion having a generally rectangular parallelpiped configuration and including a pair of facially opposing first portion sidewalls, a first portion front wall, a first portion rear wall with the first portion front and rear walls connected to the pair of first portion sidewalls to form a substantially rectangular cross-sectional configuration, the first portion front wall and the first portion rear wall having a first width;

a second portion having a generally rectangular parallelpiped configuration and including a pair of facially opposing second portion sidewalls, a second portion front wall and a second portion rear wall with the second portion front and rear walls connected to the pair of second portion sidewalls to form a substantially rectangular cross-sectional configuration, the second portion front wall and the second portion rear wall having a second width being less than the first width, the first portion and the second portion being connected together at respective ones of the first and second portion front walls, the first and second portion rear walls and the pairs of first and second portion sidewalls to form a stepped portion at least between respective ones of the connected pairs of the first and second portion sidewalls;

an insertion hole formed in the second portion front wall and facing the inner surface of said first wall of said head holder, the insertion hole allowing said ink supply member to communicate with an interior of the cartridge; and a protruding section of the first portion protruding outwardly from a plane including the second portion rear wall with a protruding section protrusion distance, the protruding section being disposed offset relative to the ink supply member when the ink supply member is inserted in the insertion hole;

wherein the protruding section protrusion distance is greater than the ink supply member protrusion distance and said contact portion of said first wall contacting the protruding section when the ink cartridge is inserted reversibly into the head holder.

2. A connecting structure according to claim 1, said protruding section comprising a grip section protruding outwardly from the plane including the second portion rear wall of said ink cartridge, wherein the grip section comprising a bottom edge, a first height defined from an upper surface of said second wall of said head holder to the bottom edge of said grip section is greater than a second height defined from an upper surface of said second wall to a top edge of said ink supply member.

3. A connecting structure according to claim 1, wherein said head holder comprises at least one partition wall for positioning the ink cartridge, the partition wall is in contact with the second portion of said ink cartridge, and the ink cartridge having the second width smaller at the second portion in contact with said partition wall than at the first portion of the ink cartridge.

4. A connecting structure according to claim 1, wherein said head holder comprises a plurality of partition walls for positioning at least one ink cartridge, each adjacent partition wall is separated by a width substantially equal to the second width of the second portion of the ink cartridge.

5. A connecting structure according to claim 1, wherein the ink cartridge further comprises a separate cover joined to the ink cartridge.

6. A connecting structure according to claim 1, wherein the filter is a mesh filter for removing impurities from the ink within the ink cartridge.

7. A connecting structure according to claim 1, wherein the ink cartridge includes an ink-impregnated body.

8. A connecting structure according to claim 1, wherein the first width extends in a first width direction being perpendicular to an insertion direction of the ink cartridge into the head holder and the second width extends in a second width direction being parallel to the first width direction and perpendicular to the insertion direction.

9. A connecting structure according to claim 1, wherein the head holder further comprises a third wall being disposed opposite and substantially parallel to the second wall with the first wall being substantially perpendicular to the second wall, the first, second and third walls defining a cartridge receiving portion having a shape sized to receive the ink cartridge shaped as a substantially rectangular parallelepiped.

10. A connecting structure, comprising:

a head holder comprising:

a first wall;

a second wall; and an ink supply member protruding inwardly from an inner surface of said first wall with an ink supply member protrusion distance, the ink supply member supplying ink to an ink jet head;

a cartridge mounting section formed in said second wall; and an ink cartridge comprising:

a first portion having a generally rectangular parallelpiped configuration and including a pair of facially opposing first portion sidewalls, a first portion front wall, a first portion rear wall with the first portion front and rear walls connected to the pair of first portion sidewalls to form a substantially rectangular cross-sectional configuration, the first portion front wall and the first portion rear wall having a first width;

a second portion having a generally rectangular parallelpiped configuration and including a pair of facially opposing second portion sidewalls, a second portion front wall and a second portion rear wall with the second portion front and rear walls connected to the pair of second portion sidewalls to form a substantially rectangular cross-sectional configuration, the second portion front wall and the second portion rear wall having a second width being less than the first width, the first portion and the second portion being connected together at respective ones of the first and second portion front walls, the first and second portion rear walls and the pairs of first and second portion sidewalls to form a stepped portion at least between respective ones of the connected pairs of the first and second portion sidewalls;

an insertion hole formed in the second portion front wall of the ink cartridge facing the inner surface of said first wall of said head holder, the insertion hole allowing said ink supply member to communicate with an interior of the ink cartridge; and a protruding section of the first portion protruding outwardly from a plane including the second portion rear wall of said ink cartridge with a protruding section protrusion distance, the protruding section being disposed offset relative to the ink supply member when the ink supply member is inserted in the insertion hole;

wherein the protruding section protrusion distance is greater than the ink supply member protrusion distance and said contact portion of said first wall contacting the protruding section when the ink cartridge is inserted reversibly into the head holder.

11. A connecting structure according to claim 10, said protruding section comprising a grip section protruding outwardly from the plane including the second portion rear wall of said ink cartridge, wherein the grip section comprising a bottom edge, a first height defined from an upper surface of said second wall of said head holder to the bottom edge of said grip section, is greater than a second height defined from an upper surface of said second wall to a top edge of said ink supply member.

12. A connecting structure according to claim 10, wherein said head holder comprises at least one partition wall for positioning an ink cartridge, the partition wall is in contact with the second portion of said ink cartridge, the ink cartridge having the second width smaller at the second portion in contact with said partition wall than at the first portion of the ink cartridge.

13. A connecting structure according to claim 10, wherein said head holder comprises a plurality of partition walls for positioning at least one ink cartridge, each adjacent partition wall is separated by a width substantially equal to the second width of the second portion of the ink cartridge.

14. A connecting structure according to claim 10, wherein the first width extends in a first width direction being perpendicular to an insertion direction of the ink cartridge into the head holder and the second width extends in a second width direction being parallel to the first width direction and perpendicular to the insertion direction.

15. A connecting structure according to claim 10, wherein the head holder further comprises a third wall being disposed opposite and substantially parallel to the second wall with the first wall being substantially perpendicular to the second wall, the first, second and third walls defining a cartridge receiving portion having a shape sized to receive the ink cartridge shaped as a substantially rectangular parallelepiped.

16. An ink cartridge for mounting to a head holder that includes an ink supply member that protrudes at an ink supply member protrusion distance, the ink cartridge comprising:

a first portion having a generally rectangular parallelpiped configuration and including a pair of facially opposing first portion sidewalls, a first portion front wall, a first portion rear wall with the first portion front and rear walls connected to the pair of first portion sidewalls to form a substantially rectangular cross-sectional configuration, the first portion front wall and the first portion rear wall having a first width;

a second portion having a generally rectangular parallelpiped configuration and including a pair of facially opposing second portion sidewalls, a second portion front wall and a second portion rear wall with the second portion front and rear walls connected to the pair of second portion sidewalls to form a substantially rectangular cross-sectional configuration, the second portion front wall and the second portion rear wall having a second width being less than the first width, the first portion and the second portion being connected together at respective ones of the first and second portion front walls, the first and second portion rear walls and the pairs of first and second portion sidewalls to form a stepped portion at least between respective ones of the connected pairs of the first and second portion sidewalls;

an insertion hole formed in the second portion front wall of the ink cartridge and facing an inner surface of a first wall of said head holder, the insertion hole allowing communication with an interior of the cartridge; and a protruding section of the first portion protruding outwardly from a plane including the second portion rear wall of said ink cartridge with a protruding section protrusion distance, the protruding section being disposed offset relative to the ink supply member when the ink supply member is inserted in the insertion hole;

wherein the protruding section protrusion distance is greater than the ink supply member protrusion distance and said contact portion of said first wall contacting the protruding section when the ink cartridge is inserted reversibly into the head holder.

17. A cartridge according to claim 16, said protruding section comprising a grip section protruding outwardly from the plane including the second portion rear wall of said ink cartridge, wherein the grip section comprising a bottom edge, a first height defined from an upper surface of a second wall of said head holder to the bottom edge of said grip section is greater than a second height defined from an upper surface of said second wall to the top edge of said ink supply member.

18. A cartridge according to claim 16, wherein the ink cartridge can be positioned between a plurality of partition walls, and each adjacent partition wall is separated by a width substantially equal to the second width of the second portion of the ink cartridge.

19. A cartridge according to claim 18, wherein the ink cartridge is in contact with and positioned between partition walls of the head holder and has the second width smaller at the second portion in contact with said partition wall than at the first portion.

20. A connecting structure according to claim 16, wherein the ink cartridge includes an ink-impregnated body.

21. A connecting structure according to claim 16, wherein the first width extends in a first width direction being perpendicular to an insertion direction of the ink cartridge into the head holder and the second width extends in a second width direction being parallel to the first width direction and perpendicular to the insertion direction.

22. A connecting structure according to claim 16, wherein the head holder further comprises a third wall being disposed opposite and substantially parallel to the second wall with the first wall being substantially perpendicular to the second wall, the first, second and third walls defining a cartridge receiving portion having a shape sized to receive the ink cartridge shaped as a substantially rectangular parallelepiped.

* * * * *